United States Patent [19]

Muse

[11] 4,123,881

[45] * Nov. 7, 1978

[54] WALL STRUCTURE WITH INSULATED INTERFITTING BLOCKS

[76] Inventor: George B. Muse, Hillcrest Dr., Calhoun, Ga. 30701

[ * ] Notice: The portion of the term of this patent subsequent to Dec. 21, 1993, has been disclaimed.

[21] Appl. No.: 749,784

[22] Filed: Dec. 13, 1976

Related U.S. Application Data

[63] Continuation-in-part of Ser. No. 548,385, Feb. 10, 1975, Pat. No. 3,998,022, which is a continuation-in-part of Ser. No. 252, Jan. 2, 1970, Pat. No. 3,864,885, and Ser. No. 462,376, Apr. 19, 1974, abandoned, each being a continuation-in-part of Ser. No. 802,450, Feb. 26, 1969, Pat. No. 3,609,926, which is a continuation-in-part of Ser. No. 658,524, Aug. 4, 1967, Pat. No. 3,479,782, and Ser. No. 730,727, May 21, 1968, abandoned.

[51] Int. Cl.[2] ..... E04C 1/04

[52] U.S. Cl. ..... 52/100; 52/213; 52/293; 52/309.12; 52/405; 52/438; 52/439; 52/574; 52/611

[58] Field of Search ..... 52/98, 100, 122, 405, 52/438, 574, 584, 604, 611, 747, 213, 293, 309.12, 439

[56] References Cited

U.S. PATENT DOCUMENTS

| | | | |
|---|---|---|---|
| 802,566 | 10/1905 | Harris | 52/564 |
| 1,201,408 | 10/1916 | White | 52/574 |
| 1,332,409 | 3/1920 | Pomerantz | 52/100 |
| 1,356,590 | 10/1920 | Baumann | 52/574 |
| 1,771,302 | 7/1930 | Lane | 52/204 |
| 1,884,319 | 10/1932 | Smith | 52/405 |
| 2,065,510 | 12/1936 | Bennett | 52/122 X |
| 2,068,831 | 1/1937 | Washburn et al. | 52/428 X |
| 2,273,775 | 2/1942 | Strong | 52/405 |
| 3,206,905 | 9/1965 | Wavering et al. | 52/743 |
| 3,314,208 | 4/1967 | Robertson et al. | 52/438 |
| 3,998,022 | 12/1976 | Muse | 52/585 |

FOREIGN PATENT DOCUMENTS

| | | | |
|---|---|---|---|
| 122,906 | 12/1946 | Australia | 52/98 |
| 224,870 | 12/1962 | Austria | 52/122 |
| 875,513 | 7/1971 | Canada | 52/747 |
| 806,046 | 6/1951 | Fed. Rep. of Germany | 52/585 |
| 489,348 | 1919 | France | 52/604 |
| 2,121,369 | 8/1972 | France | 52/405 |
| 286,753 | 6/1931 | Italy | 52/98 |
| 506,271 | 12/1954 | Italy | 52/609 |
| 550,478 | 10/1956 | Italy | 52/609 |
| 49,569 | 7/1921 | Sweden | 52/611 |
| 459,516 | 9/1968 | Switzerland | 52/100 |

*Primary Examiner*—Alfred C. Perham
*Attorney, Agent, or Firm*—Jones, Thomas & Askew

[57] ABSTRACT

T-shaped building blocks are assembled in a wall structure in horizontal courses of blocks, with alternate ones of the blocks in each course facing opposite directions and with the main body sections of each block overlying the main body sections of the next adjacent blocks. The blocks in the first course are placed on a footing, U-shaped clips tie the overlying portions of the main body sections of the blocks together to form rigid wall sections, and the wall sections are leveled by inserting wedges beneath the bottom course of blocks. Mortar is poured into the vertical openings of the bottom course of blocks to rigidly mount the blocks on the footing. As the wall increases in height, vertical tie rods are inserted internally through the course of blocks to tie the blocks in adjacent courses together. Insulation is placed in the vertical openings in the blocks to reduce the passage of heat and moisture through the blocks in the wall structure.

20 Claims, 11 Drawing Figures

WALL STRUCTURE WITH INSULATED INTERFITTING BLOCKS

CROSS-REFERENCE TO RELATED APPLICATIONS

This application is a continuation-in-part of application Ser. No. 548,385, filed Feb. 10, 1975, now U.S. Pat. No. 3,998,022; which application is a continuation-in-part of application Ser. No. 252, filed Jan. 2, 1970 now U.S. Pat. No. 3,864,885 and of application Ser. No. 462,376, filed Apr. 19, 1974 now abandoned, which applications are both continuations-in-part of application Ser. No. 802,450, filed Feb. 26, 1969, now U.S. Pat. No. 3,609,926 which application is a continuation-in-part of application Ser. No. 658,524, filed Aug. 4, 1967 now U.S. Pat. No. 3,479,782 and of application Ser. No. 730,727, filed May 21, 1968 now abandoned.

BACKGROUND OF THE INVENTION

In the past, wall structures formed from building blocks, etc. typically have been constructed by the placement of blocks one upon the other, in vertical overlying relationship and in horizontal courses of blocks with mortar in contact with both the horizontal and vertical external surfaces of the blocks. The construction of walls in this manner requires a relatively skilled mason in order to form the wall in an upright attitude and to place the blocks in substantially equally spaced relationship from one another throughout the wall structure. When the wall structure has been formed, it is sometimes found that the wall is out of plumb or that the wall should be changed for some reason. Moreover, the horizontal strength characteristics of conventionally-formed block walls is not particularly good unless the wall is fabricated from relatively thick blocks or unless the wall is formed with additional thicknesses of materials, such as another layer of blocks or bricks. Furthermore, the conventional prior art block walls are not very good heat insulators and moisture usually can easily pass through the wall structure, either through the block material or through the cracks and openings in the mortar between the blocks. The utility of the conventional prior art blocks is limited with respect to tying the blocks together with a hurricane beam or the like, for extending electrical or water conduits horizontally through a wall structure, or for supporting window assemblies in a wall structure. Special modifications of the blocks and of other components of a wall structure must be made to accommodate these and other items that are desired to be present in a typical wall sturcture.

SUMMARY OF THE INVENTION

Briefly described, the present invention comprises a wall structure formed from a plurality of building blocks, wherein the majority of the blocks are of T-shaped configuration having a main body section and a side body section, with the top and bottom surfaces of the main and side body sections being coplanar, and with the end portions of the main body section extending beyond the end walls of the side body section. Vertically extending openings are present in both the main body section and the side body section of each block, and recesses are formed in the upper surface of the end portions of the main body section, so that when a plurality of the blocks are placed in a wall structure in a horizontal course of blocks, with alternate ones of the blocks facing in opposite directions, the end portions of the main body sections of adjacent blocks overly each other and the recesses in adjacent blocks are in alignment with each other. U-shaped clips are inserted about adjacent ones of the blocks, with the base leg of the U-shaped clip received in the aligned recesses of the adjacent blocks and with the downward extending opposite legs of the U-shaped clips projecting into the vertical openings in the end portions of the main body section of the blocks. The blocks are held in side-by-side, abutting relationship by the clips.

When a wall is being formed on a footing, etc., the blocks in the first or bottom course of blocks are placed in abutting overlying alignment with each other, the blocks are clipped together with the U-shaped clips to rigidify several blocks into a rigid section of blocks, and the bottom course of blocks is leveled by inserting wedges between the bottom surfaces of the blocks and the footing. A thin mortar is poured into the vertical openings of the blocks, and portions of the mortar seep between the bottom surfaces of the blocks and the footing to help fill the spaces formed by the wedges, and the hardened mortar later helps to support the wall structure as well as to rigidly mount the wall structure on the footing. The vertically extending openings in the blocks can be filled with an insulation material so as to retard the seepage of moisture through the wall structure and to retard the transfer of heat through the wall structure. The horizontal courses of blocks are anchored together by the insertion of rectilinear tie rods downwardly through vertical internal slots formed at the intersections of the main body sections with the side body sections of the adjacent blocks in each course.

In one embodiment of the invention, knock-out sections are formed in the blocks so that the blocks in a single course of blocks can have their knock-out portions removed and a horizontally extending tie or conduit, etc. can be extended through the wall structure.

Thus, it is an object of this invention to provide a building block which is suitable for rapid and accurate and strong wall construction and which is easily plumbed and which retards the passage through the wall structure of both moisture and heat.

Another object of this invention is to provide a wall structure that has good heat and liquid insulation qualities.

Another object of this invention is to provide a building block with knock-out portions that can be removed to form a horizontal slot longitudinally through the upper surface of the block for the passage therethrough of electrical and fluid conduits or the like, and other rectilinear elements such as tie rods, etc.

Another object of this invention is to provide building blocks that can be expediently formed into an accurate and strong wall structure that is attractive and utilitarian.

Other objects, features and advantages of the present invention will become apparent upon reading the following specification, when taken in conjunction with the accompanying drawing.

DETAILED DESCRIPTION

Figure 1:
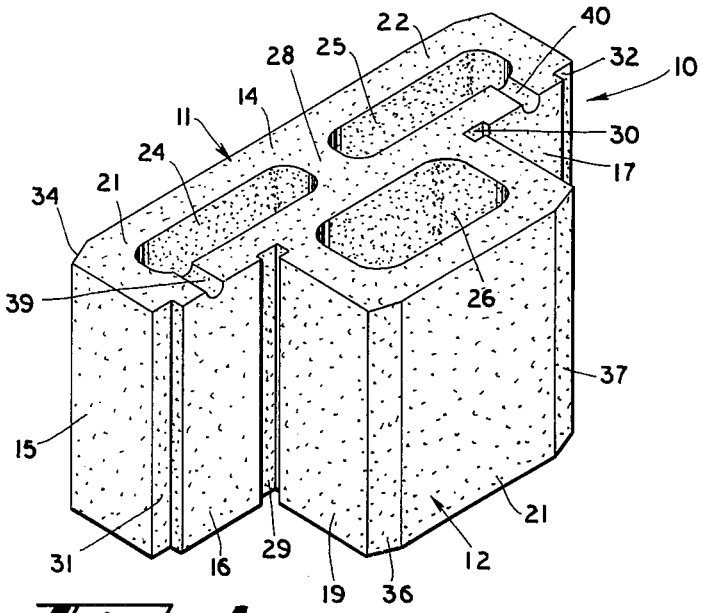
FIG. 1 is a perspective view of a T-shaped building block.

Referring now in more detail to the drawing, in which like numerals indicate like parts throughout the several views, FIG. 1 illustrates a T-shaped block 10 which includes a main body portion 11 and a side body portion 12, both of which are approximately rectangular in exterior shape. The main body portion 11 includes a top surface 14, a bottom surface (not shown) which is opposite from a top surface and similar thereto, duplicate end walls 15, side walls 16 and 17 which are adjacent the side body portion 12, and a side wall 18 (FIG. 6) which is opposite from the side body section 12. The side body section 12 includes end walls 19 and 20 (FIGS. 1 and 4) and side wall 21 which is on the side of the body section 12 opposite from the main body section 11.

Side body section 12 is substantially equal in thickness to the main body section 11, and main body section 11 is longer than side body section 12 and includes end portions 21 and 22 that extend beyond the end walls 19 and 20 of the side body section 12 a distance approximately equal to the width of the main body section 11.

In the embodiment illustrated herein, the length of the main body section 11 is approximately 16 inches, the length of the side body section 12 is approximately 8 inches, the width of the main body section and the width of the side body section are both approximately 4 inches. The thickness or height of the block 10 is approximately 8 inches. The end portions 21 and 22 of the main body section 11 extend approximately 4 inches beyond the end walls 19 and 20 of the side body section 12. It will be understood by those skilled in the art that the length of the building blocks 10 is slightly foreshortened so that when a series of blocks are laid end-to-end, the additional space between the blocks which is required in laying the blocks end-to-end will not cause the multiple number of blocks to exceed a round number multiple of the length of the blocks. For example, while block 10 is disclosed as being approximately 16 inches in length, the actual length dimensions are 15 15/16 inches, with the one sixteenth of an inch being the anticipated spacing required between adjacent ones of the blocks in a course of blocks.

Vertical openings 24 and 25 are formed in the main body section 11 of block 10, a third vertical opening 26 is formed in the side body section of the block, and the vertical openings 24–26 extend entirely through the block from its bottom surface to its top surface. The openings 24, 25 and 26 are elongated and with their long dimensions extending along the length of the block. The vertical opening 26 is staggered with respect to the vertical openings 24 and 25, so that the opening 26 is in alignment with respect to the partition 28 in main body section 11 between openings 24 and 25. The openings 24, 25 and 26 are sized and shaped so that the block 10 is formed with approximately uniform thickness between its exterior surfaces and the openings 24, 25 and 26, so that when the block is being formed by the introduction of the block material into a mold and by vibrating the mold, the material will settle approximately uniformly throughout the mold, and the block which is subsequently formed by baking in a kiln will be substantially of uniform density throughout and therefore of substantial uniform strength.

A pair of rectangular vertical slots 29 and 30 are formed at the intersection of the end walls 19 and 20 of the side body section 12 and the side walls 16 and 17 of the main body section 11. The slots 29 are approximately rectangular in their shape, but the plane of side walls 16 and 17 bisects the slots 29 and 30, so that the slots 29 and 30 are located exactly in the middle of the width of the blocks 10. Vertically extending notches 31 and 32 are formed at the intersection of side walls 16 and 17 with their respective end wall 15. Vertical bevels 34 and 35 are formed at the ends of the long side wall 18 of the main body portion 11 adjacent the end walls 15, and vertical bevels 36 and 37 are formed at the opposite ends of side wall 21 of the side body portion 12 adjacent its end walls 19 and 20. Recesses 39 and 40 are formed in the upper surface of the main body section 11 and extend between the openings 24 and 25 and the side walls 16 and 17. The recesses 39 and 40 are accurately located at the center of the length of the end portions 21 and 22 of the main body section 11.

Figure 2:
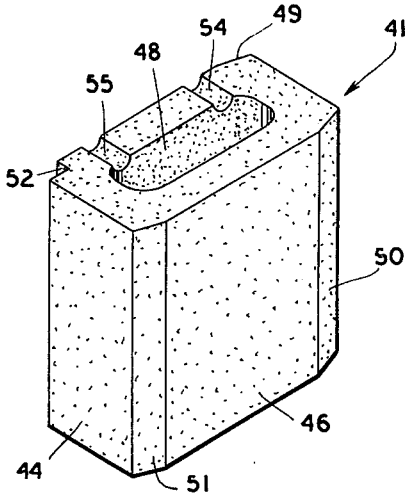
FIG. 2 is a perspective illustration of a one-half block.

FIG. 2 illustrates a half block 41 which comprises a flat upper surface 41, a a flat lower surface (not shown) which is similar to upper surface 41, with the upper and lower surfaces being parallel to each other, end walls 44 and 45 (FIGS. 2 and 7) and side walls 46 (only one illustrated) on opposite sides of the block. The side walls are both flat and parallel to each other and the end walls are both flat and parallel to each other. A central opening 48 is formed in the half block 41, and the opening 48 is elongated and its length extends along the length of the block. The size and shape of central opening 48 is such that the side and end exterior surfaces of the block are approximately equally spaced from the opening 48, so that the block is substantially uniformly formed, as described above. Vertical bevels 49, 50 and 51 are formed at the ends of the side walls of the blocks, and vertical notch 52 is formed at the end of one of the side walls. Recesses 54 and 55 are formed in the top surface of the blocks and the recesses extend from the central opening 48 to the side wall of the block which has a vertical notch 52 formed therein.

In the embodiment illustrated, the half block 41 is approximately 8 inches in length and 4 inches in width and 8 inches in height, the notch 52 is of equal dimensions with respect to notch 32 of the T-shaped block 10, and the bevels 49, 50 and 51 are approximately equal in angles and dimensions with respect to the bevels 34, 35, 36 and 37 of the T-shaped block, and the recesses 54 and 55 are approximately equal in width and depth to the width and depth of the recesses 39 and 40 of the T-shaped block.

Figure 3:
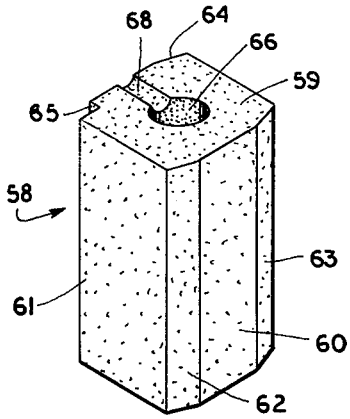
FIG. 3 is a perspective illustration of a quarter block.

FIG. 3 illustrates the quarter block 58 which is approximately square in horizontal cross section and which includes an approximately flat top surface 59, a flat bottom surface (not shown) which is parallel to and approximately similar to a flat top surface 59, opposite side wall 60 (only one shown) and opposite end wall 61 (only one shown). Vertical bevels 62, 63 and 64 are formed at the ends of the side wall 60 and intersect the end wall 61, while vertical notch 65 is formed in one of the side walls 60 and intersects the adjacent end wall 61. The angles and dimensions of the bevels 62, 63 and 64 are equal to the angles and dimensions of the bevels 34, 35, 36 and 37 of the T-shaped block 10. The angles and dimensions of the vertical notch 65 are equal with respect to the angles and dimensions of the vertical notches 31 and 32 of the T-shaped blocks 10. A vertical opening 66 is formed centrally in the quarter block 58 and the exterior side and end surfaces of the block are approximately equally spaced from the vertical opening 66. In the embodiment illustrated, the quarter block of FIG. 3 is approximately 4 inches in length and in width and 8 inches in height or thickness. Recess 68 is formed in top surface 59 of the quarter block and extends between the opening 66 and the end wall which is opposite to the end wall 61 shown in FIG. 3. The dimensions of recess 68 are equal to the dimensions of the recesses 39 and 40 of the T-shaped block 10.

Figure 4:
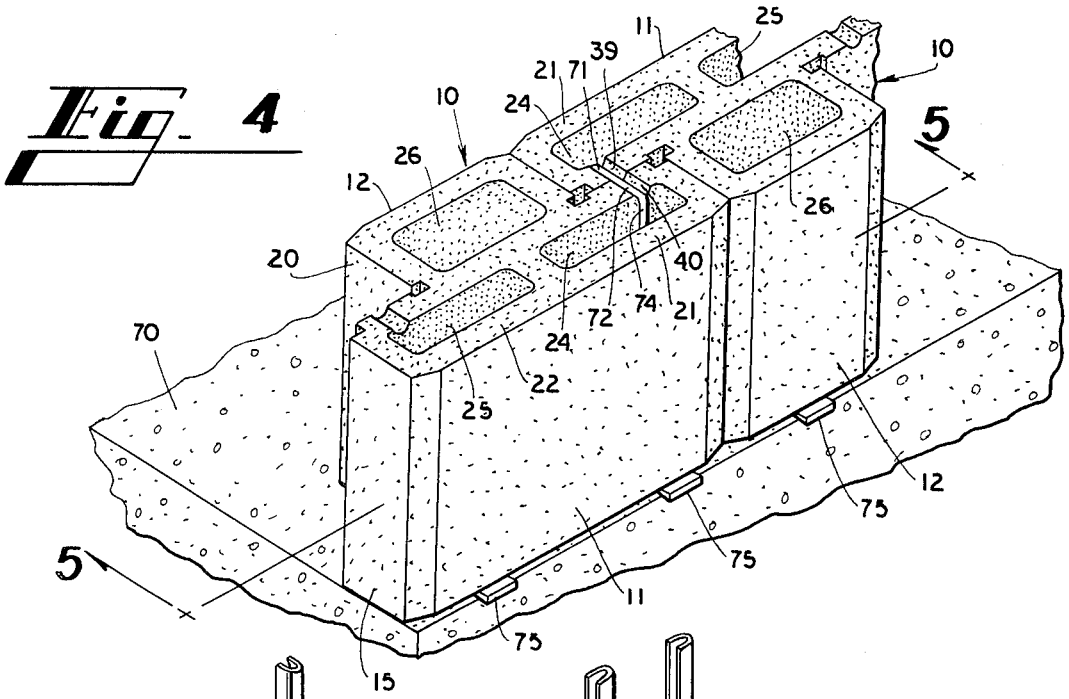
FIG. 4 is a perspective illustration of a portion of a footing and a pair of adjacent building blocks as they are mounted in the bottom course of blocks on the footing.
Figure 6:
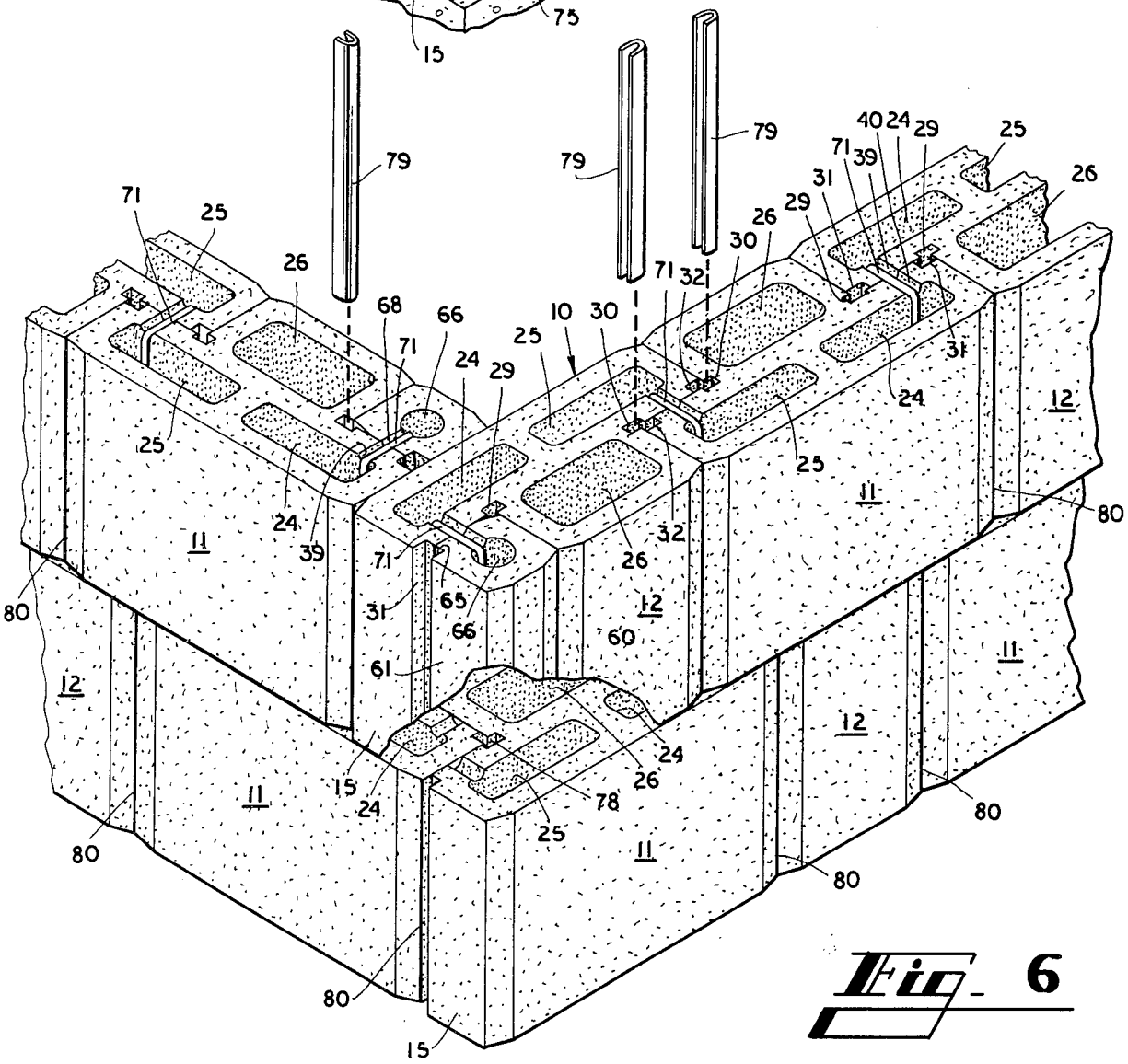
FIG. 6 is a perspective illustration of a portion or a corner of a wall structure, with parts broken away, and with parts shown in exploded view, showing both T-shaped and quarter blocks.
Figure 7:
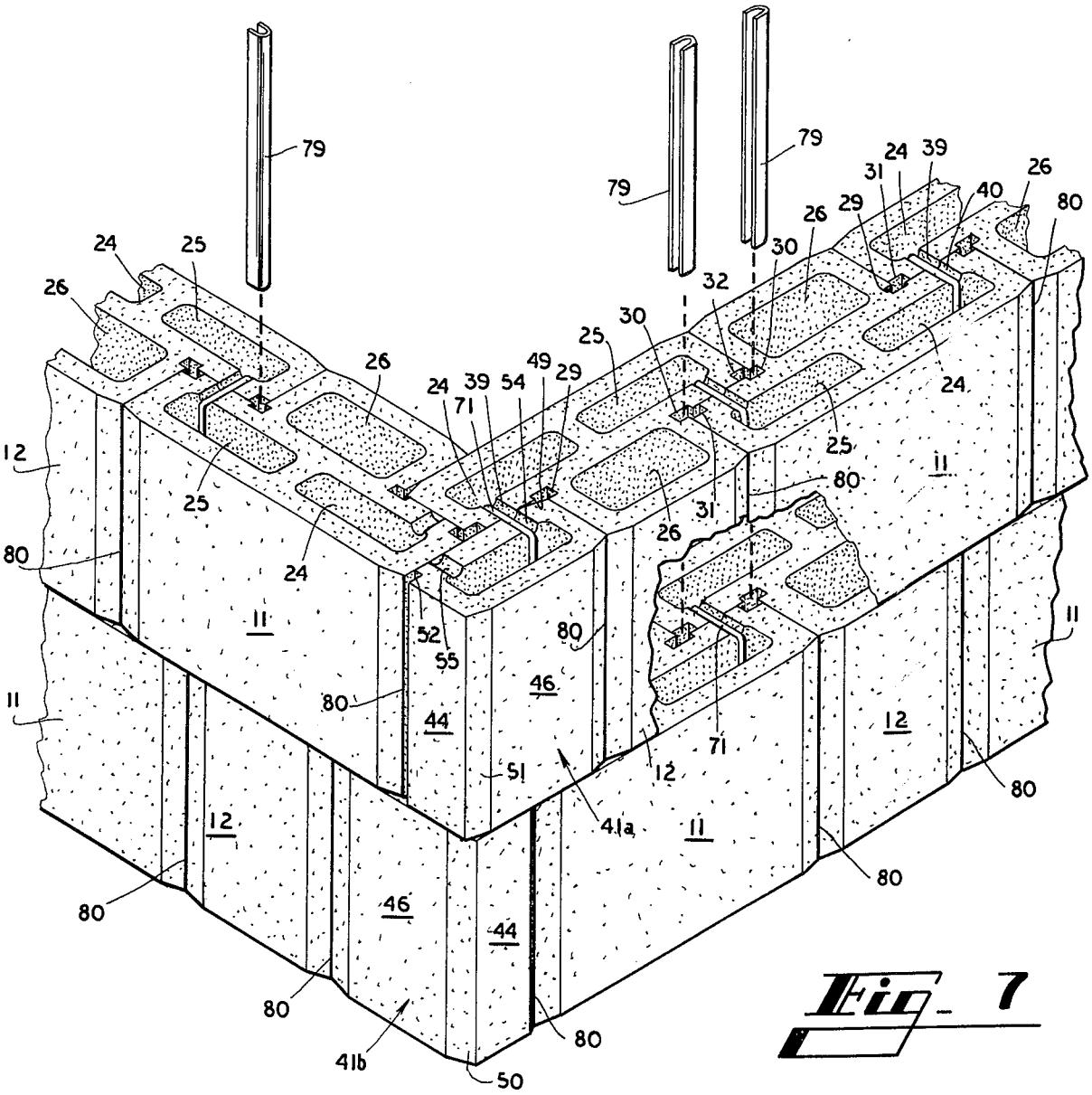
FIG. 7 is a perspective illustration of a corner of a wall structure, similar to FIG. 6, but showing a wall structure having T-shaped and half blocks.
Figure 8:
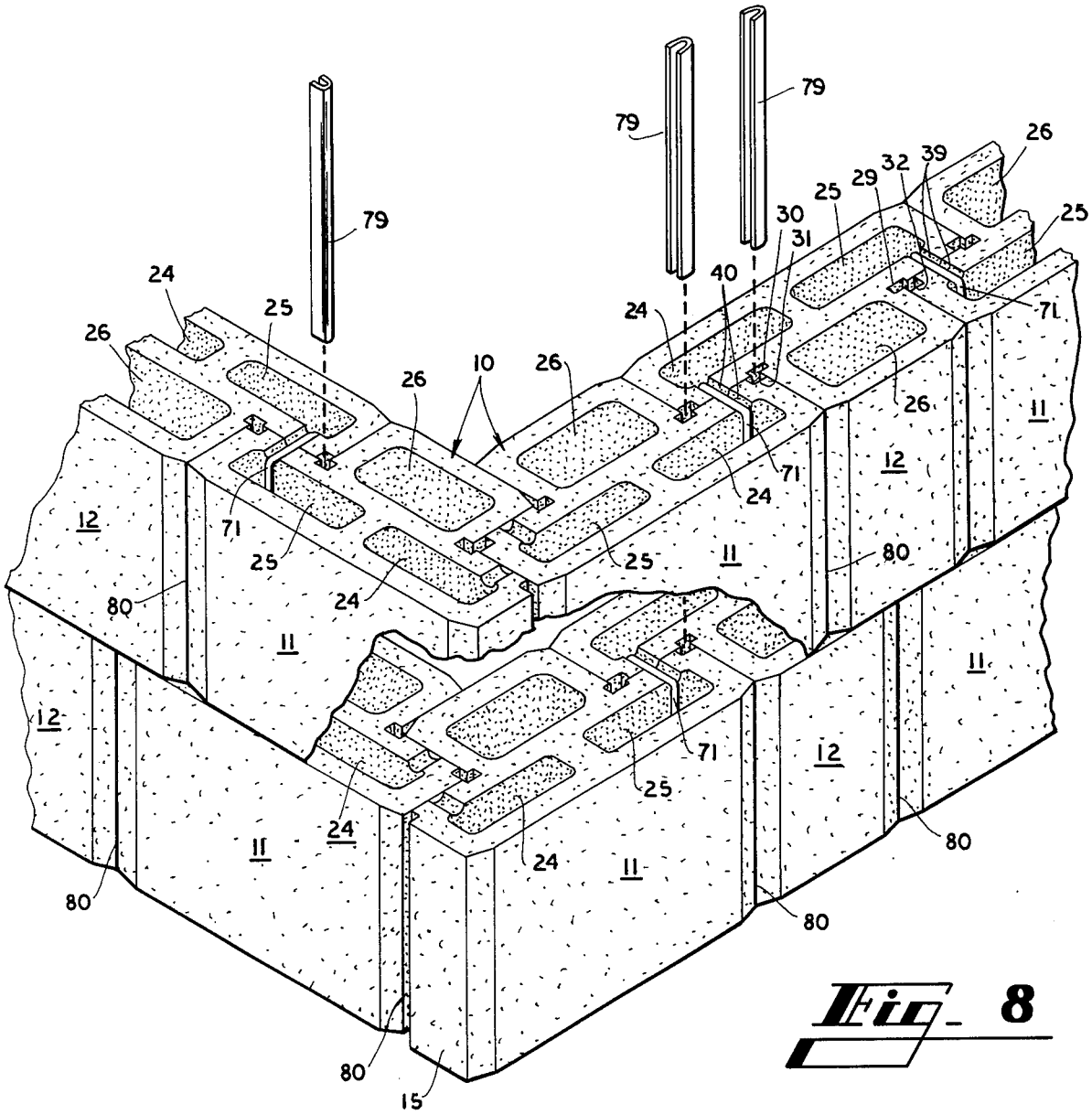
FIG. 8 is a perspective illustration of a corner of a wall structure, similar to FIGS. 6 and 7, but showing a wall structure having only T-shaped blocks.

As illustrated in FIGS. 6, 7, and 8, the blocks of FIGS. 1–3 can be assembled to form wall structures. FIG. 4 illustrates the manner in which the blocks are first placed in a course on a footing or foundation 70. The foundation 70 can be a concrete slab formed in the usual manner. The workman usually forms a chalk line (not shown) along the footing in the usual manner and then places a plurality of the blocks along the chalk line. FIG. 4 illustrates a pair of T-shaped blocks placed on footing 70 with the blocks facing in opposite directions and with their end portions 21 overlying each other and with the end walls of the main body section 11 of each block in abutment with the end wall of the side body section 12 of the adjacent block. Several blocks will be placed in this manner along the footing, and the blocks are clipped together with U-shaped clips 71. Each U-shaped clip includes a base leg 72 that extends along the aligned recesses 39 and 40 of the adjacent blocks and downwardly extending legs 74 that extend downwardly into the openings 24 and 25 of the blocks. The U-shaped clips are formed so that they tightly grip the adjacent blocks together so that the side wall surfaces 16 and 17 are urged into abutment with each other. Several of the blocks are thus rigidly held together like one block. With several of the blocks firmly held together in this manner by the U-shaped clips, the workman then determines if the blocks are level. If the blocks are not level, a plurality of wedges 75 are inserted beneath the blocks, between the blocks and the footing 70, so as to tilt a section of the blocks toward a level or upright attitude. After several of the adjacent blocks which are connected together by the U-shaped clips 71 have been leveled in this manner, a thin mortar 76 (FIG. 5) is poured down into the vertical openings 24, 25 and 26. The thin mortar tends to seep out into the cracks or spaces formed beneath the blocks in the lower course of blocks and the footing 70 so as to at least partially fill the spaces. The mortar thus tends to rigidly mount the blocks 10 on the footing 70 and the mortar tends to seal the cracks between the footing and the blocks. Moreover, the hardened mortar that is present between the bottom surfaces of the blocks and the footing 70 functions to partially support the wall structure.

If the bottom course of blocks is to be formed with half blocks or quarter blocks (FIGS. 2 and 3), these blocks can be tied together by the U-shaped clips by aligning the recesses 54, 55 and 68 of these blocks with the recesses of the T-shaped blocks and inserting the U-shaped clips 71 into the recesses. The leveling and pouring steps for the half blocks and quarter blocks will be the same as with the T-shaped blocks.

As illustrated in FIG. 6, a wall structure is illustrated wherein T-shaped and quarter blocks are utilized. Quarter blocks **58*a* are used in the corner of the wall structure, in alternate courses of the wall structure, to form the vertical edge of the wall. Quarter blocks 58*b* are used in the same alternate courses of blocks in the wall structure at the internal portion of the corner structure. The T-shaped blocks 10 are arranged in alternate facing relationship and the T-shaped blocks as well as the quarter blocks are clipped together with the U-shaped clips 71 as described previously. The notches 31 and 32 at the opposite ends of the main body section 11 of the T-shaped block register with the slots 29 and 30 of the next adjacent T-shaped blocks, and the vertical notches 65 of the quarter block register with the notches 29 and 30 of the T-shaped blocks. The registering notches and slots in the system of blocks form small vertical openings 78 in each course of blocks, and the dimensions of the blocks are such that the small vertical openings 78 in each course of blocks register with the small vertical openings formed in the courses of blocks next above and next below. Locking rods 79 are inserted downwardly through the small rectangular vertical openings 78, and the rods are of a length sufficient to extend at least between adjacent ones of the courses of blocks. The rods 79 are U-shaped in cross-section and are resiliently expandable and contractable. When the rods are urged vertically downwardly into the aligned openings 78, the rods lock the T-shaped blocks together, so that the blocks in one course cannot be moved horizontally with respect to the blocks in the next adjacent course of blocks. Thus, the U-shaped clips 71 lock the blocks together in one course of blocks while the locking rods 79 lock the blocks together in adjacent courses of blocks. Moreover, the U-shaped clips 71 tend to orient the blocks in a single course of blocks, keeping the blocks in a plumb attitude in the same course of blocks, while the locking rods 79** tend to maintain the blocks of adjacent courses of blocks in a plumb or upright attitude.

As illustrated in FIG. 7, half blocks **41*a* and 41*b* are shown in the wall structure at the corner of the wall structure. The half blocks 41*a* and 41*b* would be alternately disposed in adjacent ones of the courses of blocks, where the length of the half blocks would extend alternately at the corner structure along the wall sections. The U-shaped clips 71 are used in conjunction with the half blocks 41*a* and 41*b* as previously described, and the vertical notches 52 of the half block registers with the vertical slots 29 and 30 of the T-shaped blocks 10. The courses of blocks of the wall structure are vertically connected by the locking rod 79**, as previously described.

As illustrated in FIG. 8, a wall structure is formed with only T-shaped blocks 10, with no half blocks or quarter blocks being used at the corner of the wall structure. As with the previous embodiments, the U-shaped clips 71 are used to rigidify the blocks into rigid wall sections in each course of blocks and the locking rods 79 are used to rigidly hold the courses together.

Figure 11:
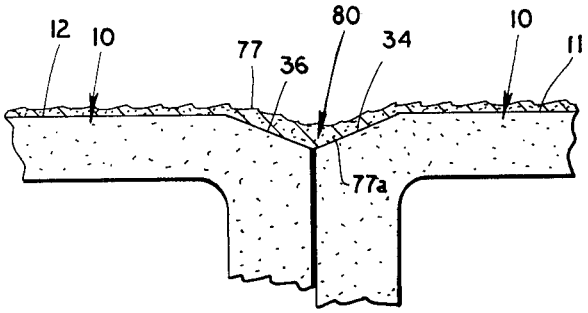
FIG. 11 is a detail top view of the bevels of adjacent blocks in a course of blocks.

As illustrated in FIG. 11, the external vertical bevels, such as bevels 34 and 36 of adjacent T-shaped blocks in a course of blocks, are placed adjacent one another at the external surfaces of the wall structure so as to form a plurality of V-shaped grooves 80 that extend vertically throughout the wall structure. Various patterns of the grooves 80 can be formed by various arrangements of the blocks, as illustrated between FIGS. 6, 7 and 8. Mortar 77 is usually sprayed on or otherwise applied to at least one exterior surface of the wall structure so as to seal the cracks between the blocks and thereby seal the wall structure. The exterior mortar also binds the blocks together and makes the wall structure more rigid. The vertical V-shaped grooves formed in the surface of the wall at adjacent blocks tend to accumulate an additional thickness of mortar 77*a* so that the vertical cracks between the blocks are plugged even when a thin layer of mortar is applied to the wall surface.

Figure 5:
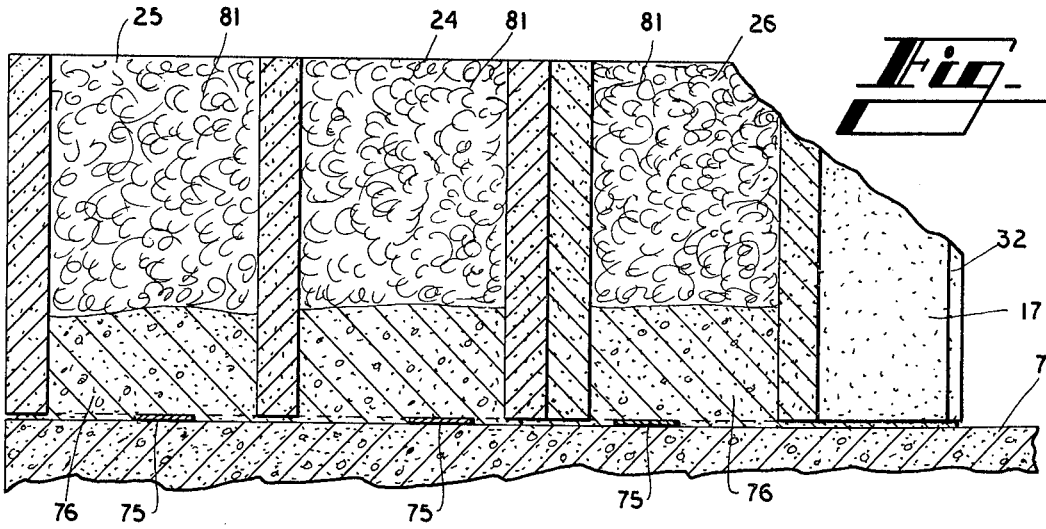
FIG. 5 is a side cross-sectional view, taken along lines 5—5 of FIG. 4, of the building blocks in a course of a wall structure.

As illustrated in FIG. 5, the vertical openings 24, 25 and 26 can be filled with an insulation material 81. The insulation material can comprise any suitable insulation material, either heat resistant or moisture resistance, or both heat resistant and moisture resistant. For example, a light insulation material such as expanded polystyrene can be placed in the openings, or a more dense material such as perlite or vermiculite can fill the openings. Moreover, sheets or boards which are fabricated from conventional insulation material such as polyurethane and molded styrofoam can be inserted vertically into the vertical openings. It is desirable to utilize insulation material that is resistant to both moisture and temperature, so that the transfer of heat and the movement of water through the blocks can be minimized. The insulation material can be mixed with a binder and placed in the blocks before the blocks are assembled in a wall structure, or the insulation material can be placed in the blocks as each course of blocks is assembled.

All of the openings in the blocks can be filled with insulation material, if desired, or some or all of the openings can remain unfilled. For example, all of the openings adjacent the outside surface of a wall of a building can be filled with insulation material and all of the openings in the wall structure adjacent the inside surface of the wall can remain unfilled.

Figure 9:
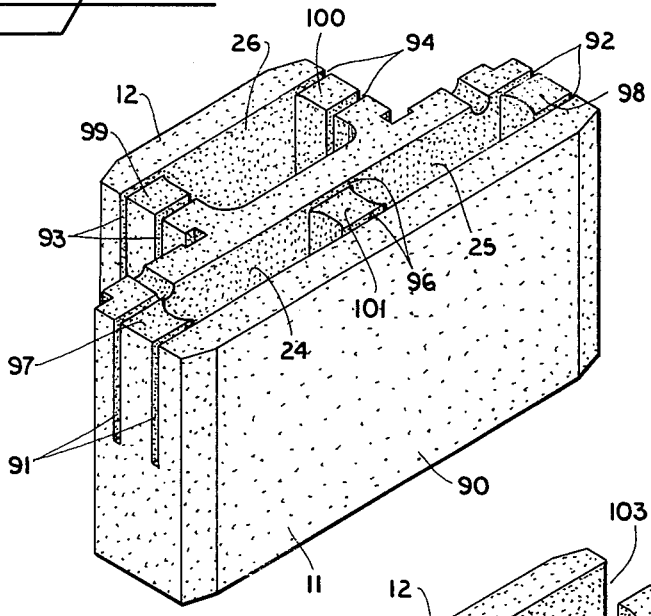
FIG. 9 is a perspective illustration of a knock-out block, with the knock-out portions still in the block.
Figure 10:
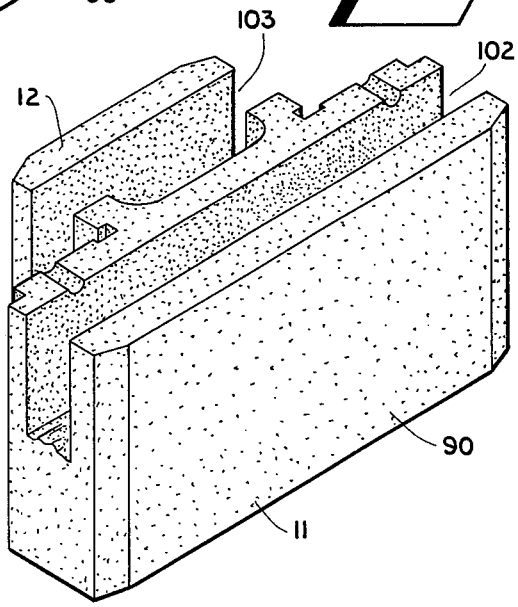
FIG. 10 is a perspective illustration of a knock-out block, similar to FIG. 8, but showing the knock-out portions of the block removed from the block.

As illustrated in FIGS. 9 and 10, a modified T-shaped block 90 is illustrated wherein the ends of both the main body section 11 and side body section 12 are trifurcated by the downwardly extending slots 91 and 92 at the ends of the main body section 11 and at 93 and 94 at the ends of the side body section 12. In a similar manner, the partition between the openings 24 and 25 includes slots 96, and the slots 91–96 extend downwardly from the top surface of the block a distance approximately equal to one-half of thickness of the block, and the slots form columns 97, 98, 99, 100 and 101 in the block structure. The relatively thin columns 97–101 can be easily broken out of the block structure by a lateral impact from a hammer or similar tool, so that the configuration of the block as illustrated in FIG. 9 will be changed to the configuration illustrated in FIG. 10, where horizontal slots 102 and 103 extend along the length of the block in both the main body section 11 and the side body section 12. The horizontal slots 102 and 103 are centrally located in each section 11 and 12 of the blocks so that the slots 102 will be in alignment with the slots 103 when the blocks are arranged in alternate opposite facing relationship in a horizontal course of blocks. Thus, rectilinear members such as electrical conduits, fluid conduits, tie rods, and other items can be extended laterally through a wall structure by placing these items in the slots 102 and 103 of the blocks in the wall structure. Also, when the knock-out blocks of FIGS. 8 and 9 are used in the uppermost course of blocks, a hurricane tie can be inserted in the blocks, by inserting an elongated rod laterally through the aligned slots 102 and 103 and pouring mortar about the rod in the slots.

The presence of the insulation 81 in the openings 24, 25 and 26, together with the offset relationship of opening 26 with respect to openings 24 and 25 tends to substantially reduce the likelihood of transfer of either heat or moisture through a single one of the blocks, and the offset relationship of the ends of the blocks with respect to one another in a single course of blocks, where the openings 24 and 25 of adjacent blocks overlap one another (FIGS. 6, 7 and 8), causes the insulation material to be arranged in a double thickness throughout the wall structure.

If it is desired to form a window opening in a wall structure, where a window assembly can be integrated into the structure, quarter blocks (FIG. 3) can be used in combination with the T-shaped blocks and half blocks (FIG. 2) and oriented so that the vertically extending notch 65 of the quarter blocks are placed adjacent the vertically extending notch 31 or 32 of the T-shaped block and adjacent the vertically extending notches 52 of the half block adjacent the window opening, so that the adjacent notches form a vertical slot at the window opening in the middle of the width of the wall structure. This allows the window to be dropped in from the upper portion of the window opening, with the material forming the window structure sliding vertically downwardly into the slot formed by the vertical notches of the blocks.

While this invention has been described in detail with particular reference to preferred embodiments thereof, it will be understood that variations and modifications can be effected within the spirit and scope of the invention as described hereinbefore and as defined in the appended claims.

I claim:

1. In a wall structure comprising a plurality of duplicate symmetrical approximately T-shaped building blocks each comprising an approximately rectangular main body section and an approximately rectangular side body section with substantially flat coplanar top surfaces and with substantially flat coplanar bottom surfaces, side walls and end walls, said side body section having approximately the same width as said main body section, said main body section being longer than said side body section and including end portions extending at its opposite ends beyond the ends of said side body section a distance at each end approximately equal to the width of said main body section, openings extending vertically through both said main body section and said side body section with the openings in said main body section extending into the central portion of each of the end portions of said main body section, a recess formed in the top surface of each of the end portions of said main body section with each recess intersecting the opening in the end portion of the main body section and the side wall of the main body section adjacent the side body section with each recess positioned centrally in the length of the end portions of said main body section, a slot defined at the intersection of each end wall of said side body section with each side wall of said main body section, with the plane of the side walls of said main body section adjacent the side body section bisecting the slots, said building blocks being arranged in horizontal courses of blocks in the wall structure with alternate ones of the blocks in each course facing opposite directions, with the end walls of the main body sections in abutment with the end walls of the side body sections, with the slots of adjacent blocks in vertical alignment with each other, and the recesses of adjacent blocks arranged in alignment with each other across the length of the course of blocks, U-shaped clips inserted in to the wall structure with the base of the U-shaped clips positioned in the aligned recesses of adjacent blocks and the legs of the clips extending into the openings of the end portions of said main body section of the building blocks whereby the facing side walls of adjacent ones of the building blocks in the wall structure are held in abutting relationship.

2. The wall structure of claim 1 and further including heat insulation material of a substance different from the composition of the blocks in the wall structure located in the openings of said blocks.

3. The wall structure of claim 1 and wherein the building blocks in the bottom course of blocks rest on a footing having an approximately level upper surface, and further including a plurality of wedges positioned between at least some of the blocks in the bottom course of blocks and the footing for leveling the bottom course of blocks.

4. The wall structure of claim 1 and wherein the building blocks in the bottom course of blocks rest on a footing, and further including mortar located in the openings of the blocks in the bottom course of blocks and in contact with the footing to rigidly mount the blocks on the footing.

5. The wall structure of claim 1 and wherein the building blocks in the bottom course of blocks are mounted on a footing having an approximately level upper surface, a plurality of wedges inserted between at least some of the blocks in the bottom course of blocks and the upper surface of the footing for leveling the wall structure, and mortar located in the openings of the blocks in the bottom course of blocks and in contact with the footing to rigidly mount the wall structure on the footing.

6. The wall structure of claim 5 and wherein some of the mortar is located between the upper surface of the footing and the blocks in the bottom course of blocks.

7. The wall structure of claim 1 and further comprising expanded polystyrene at least partially filling the openings in at least some of the blocks of the wall structure.

8. The wall structure of claim 1 and wherein at least some of said blocks define slots in their upper surfaces extending along the length of the block for receiving a rectilinear tie rod or the like internally of the wall structure.

9. The wall structure of claim 1 and wherein the main body sections and the side body sections of the blocks in at least one course of blocks define horizontally extending slots in their upper surfaces extending along their lengths, with the slots of the main body sections being aligned with the slots of the side body sections, and a rectilinear member extending through aligned ones of said slots.

10. The wall structure of claim 1 and wherein the edges of the side wall of said side body section adjacent its end walls of each block are beveled, and wherein the edges of the side wall of said main body section opposite from said side wall section adjacent its end walls are beveled, so that the bevels of the side body section of alternate ones of the blocks in a horizontal course of blocks are located adjacent the bevels of the main body section of the other alternate ones of the blocks in the horizontal course of blocks.

11. The wall structure of claim 10 and further including mortar or the like applied to at least one exterior surface of the wall structure.

12. The wall structure of claim 1 and wherein the internal openings of the blocks are at least partially filled with nonabsorbant material.

13. The building block of claim 12 and wherein the nonabsorbent material comprises perlite.

14. The building block of claim 12 and wherein the nonabsorbent material comprises vermiculite.

15. The building block of claim 12 and wherein said nonabsorbent material comprises sheet material located in said opening.

16. The building block of claim 12 wherein said nonabsorbent material comprises randomly oriented material substantially filling the opening.

17. A wall structure formed from a plurality of building blocks including similar T-shaped building blocks each including an approximately rectangular main body section and an approximately rectangular side body section, the top and bottom surfaces of said main body section and side body section being substantially coplanar, said main body section and said side body section being approximately of equal thickness, said main body section extending at its opposite ends beyond the ends of said side body section, said main body section including opposite end walls and side walls, said side body section including opposite end walls, a vertical slot formed at the intersection of each end wall of said side body section and each side wall of said main body section, a notch formed in the opposite ends of said main body section at the side walls thereof adjacent said side body section, and smaller approximately rectangular blocks of a length approximately equal to the width of said side body portion and a width approximately equal to the distance the main body sectin extends beyond said side body section, a notch formed at the intersection of a side wall and an end wall of said smaller blocks, whereby when said smaller blocks are located in the wall structure adjacent a side body portion of a T-shaped block the smaller blocks can be oriented to place the notch of the smaller blocks adjacent the notches of the main body section of the T-shaped block and form a vertical groove suitable to receive a window structure or the like or the smaller blocks can be oriented to place the notch of the smaller blocks adjacent the vertical slots of the blocks to receive a vertical rod and the like.

18. A T-shaped symmetrical bulding block comprising an elongated main body section with vertical side walls and vertical end walls and a side body section extending from one side of said main body section and of a length and width each approximately equal to the width of said main body section and including a vertical side wall and vertical end walls, said main body section being of a length longer than said side body section and extending at both of its ends beyond the ends of said side body section a distance approximately equal to the width of said main body section, a pair of slots formed in and extending vertically through said building block with each slot positioned inwardly of the junction of a vertical side wall of the main body section and a vertical end wall of the side body section with the plane of the vertical side wall of the main body section bisecting the slots, whereby when duplicate ones of the blocks are stacked in an alternating arrangment with the side body section of alternate blocks in the stack facing opposite directions the slots of the blocks in the stack are in vertical alignment.

19. The building block of claim 18 and wherein the side wall of said main body section opposite from the side body section is beveled at the intersection of the side wall with each end wall of said main body section, and wherein the side wall of said side body section is beveled at the intersection of the side wall with each end wall of said side body section, and wherein the side walls of the main body section adjacent the side body section are notched at its ends adjacent the end walls of said main body section, whereby when duplicate ones of the block in a course of blocks arranged with the end walls of a main body section of each block in abutting relationship with the end walls of a side body section of the next adjacent blocks have the notches at the intersection of the side walls of the main body section with its end walls located adjacent the slots.

20. The building block of claim 18 and further defining openings extending vertically through the end portions of said main body section, and recesses formed in the top surface of the block and extending between said openings and the side wall of said main body section adjacent said side body section.

* * * * *